United States Patent [19]

Harvey

[11] Patent Number: 4,730,139

[45] Date of Patent: Mar. 8, 1988

[54] GAS DISPLAY PANEL WITH INTERNAL HEATER

[75] Inventor: Edgar L. Harvey, Jamesburg, N.J.

[73] Assignee: Telegenix, Inc., Cherry Hill, N.J.

[21] Appl. No.: 890,507

[22] Filed: Jul. 30, 1986

[51] Int. Cl.[4] ..... H01J 17/26

[52] U.S. Cl. ..... 313/15; 313/584

[58] Field of Search ..... 313/15, 44, 582–587, 313/547, 549, 550–551; 315/169.4

[56] References Cited

U.S. PATENT DOCUMENTS 4,520,290 5/1985 Cokefair ..... 313/15

*Primary Examiner*—David K. Moore

*Assistant Examiner*—Sandra L. O'Shea

*Attorney, Agent, or Firm*—Robert A. Green

[57] ABSTRACT

A gas display panel includes a base plate carrying cathode electrodes and a face plate carrying anode electrodes, the base plate and face plate being hermetically sealed together to form an envelope which is filled with an ionizable gas and mercury vapor. The base plate carries a conductor which is used to heat the panel and this conductor extends over the surface of the base plate into the areas of the seal between the base plate and face plate and it also is positioned to provide heat at the location where a source of mercury is coupled to the base plate.

7 Claims, 6 Drawing Figures

GAS DISPLAY PANEL WITH INTERNAL HEATER

BACKGROUND OF THE INVENTION

One type of display device which is now in wide use is a gas plasma display panel which contains cathodes and anodes, and a cathode is caused to glow and represent a character when an electrical potential is connected between it and an anode. In panels of this type, mercury is provided in the gas to prevent cathode sputtering. However, when these panels are used in a low temperature environment, the mercury condenses out of the gas and is thus not available to perform its function. In addition, when the mercury condenses, it may adversely affect the part of the panel on which it condenses, for example, by shorting adjacent electrodes.

In the past, the problem of mercury condensation has been solved by providing a heater external to a panel for heating the panel and the mercury therein. Also, U.S. Pat. No. 4,520,290 describes a display panel having an internal heater strip. The disadvantages of the external heater are discussed in the patent and they are rather obvious. The panel described in the patent has the disadvantage that it does not teach of means for adjusting the resistance of the heater strip during manufacture of the panel, in fact the patent provides no teaching as to how the required resistance is achieved and how compensation for variations in manufacture can be achieved. In addition, the panel in the patent provides globules of mercury in the panel and these are heated by the heater strip. This does not avoid the problem of internal mercury shorting and does not provide desirable control of the mercury.

The present invention solves the foregoing problems by providing heater means in a gas filled display panel wherein the heater means can be controlled and adjusted easily during the manufacture of the panel to achieve the desired heating capability thereof. In addition, the heater means is positioned so that it heats mercury in the panel and the mercury source located in a tubulation secured to the outside of the panel to provide control of the mercury admitted to the panel. There are no globules of mercury in the panel which might cause electrical shorts.

DESCRIPTION OF THE INVENTION

Figure 1:
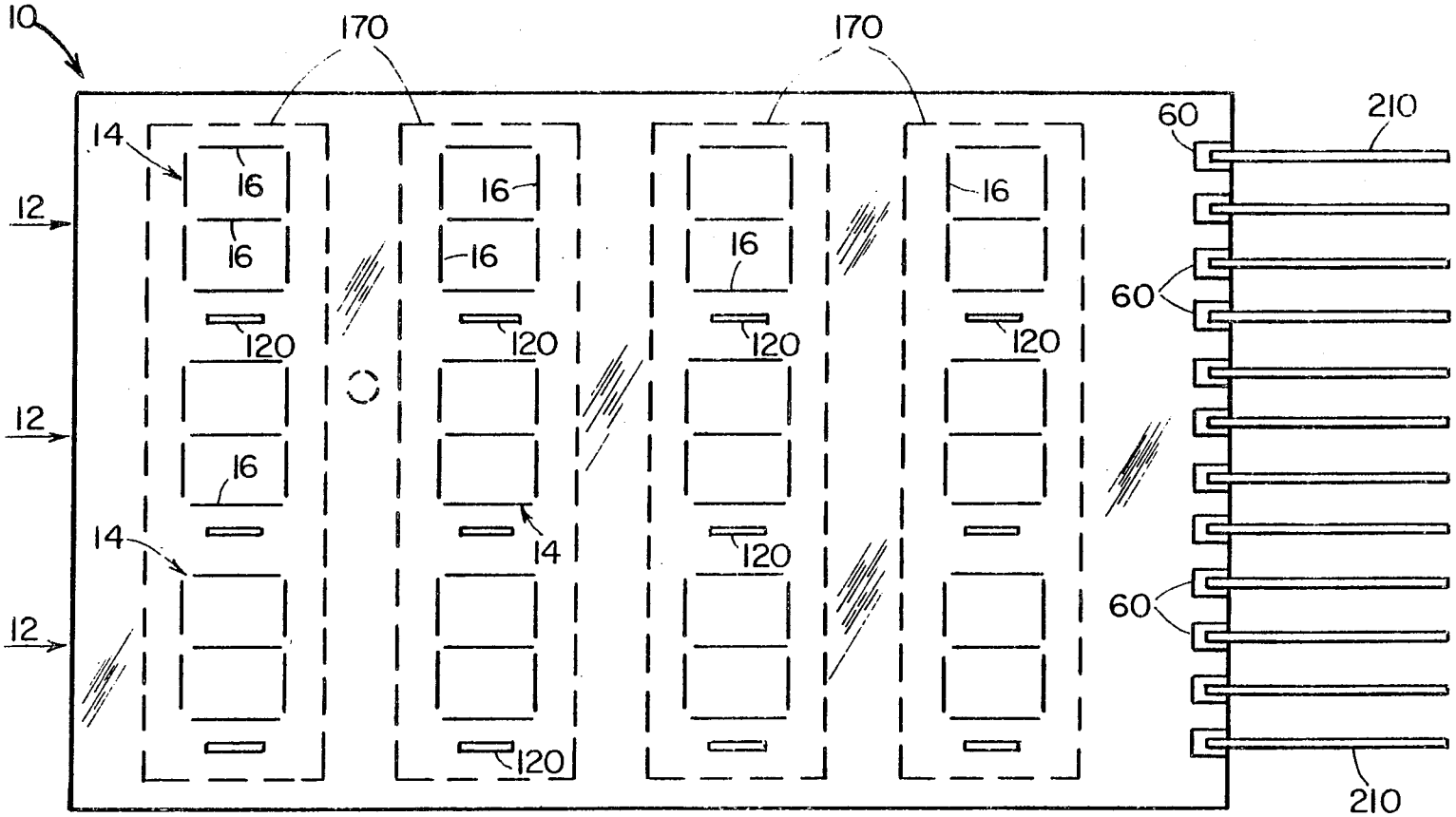
FIG. 1 is a plan view of a display panel embodying the invention.

The principles of the present invention are described with respect to a relatively large display panel 10 which, for purposes of illustration, includes three horizontal arrays 12 of character positions 14, each of which can be used to display a character. For purpose of illustration, only four character positions 14 are shown in each array of character positions. Each character position contains an array of cathode segments 16 in a figure "8" pattern and such an array of cathode segments can be connected and energized in different combinations to display the numerals "0" to "9" and other characters.

The display panel 10 includes an envelope made up of a glass base plate 20 and a transparent glass face plate 28 which are hermetically sealed together about their aligned peripheries. The panel 10 is made up of two assemblies, one formed on the base plate and one formed on the face plate. The base plate 20 (FIG. 2) includes a top surface 22, an upper edge 23, a lower edge 24, a left hand edge 25 and a right hand edge 26 and the base plate carries a plurality of electrodes and other functional elements as follows.

According to the invention, the panel includes means for providing heat continuously in order to vaporize the mercury in the panel and to keep the mercury vaporized and to prevent undesired condensation of mercury on parts of the panel. This means comprises a conductor 30 (FIG. 3) of suitable resistance, provided on the top surface 22 of the base plate and positoned so that it reaches all portions of the base plate so that the heat generated in the operating panel can affect all portions of the panel including the area of the seal between the base plate and face plate. In addition, the heater conductor is positioned so that heat is available at the mercury source so that the mercury in the source can be vaporized and made available to enter the panel. This is described below in greater detail.

Figure 3:
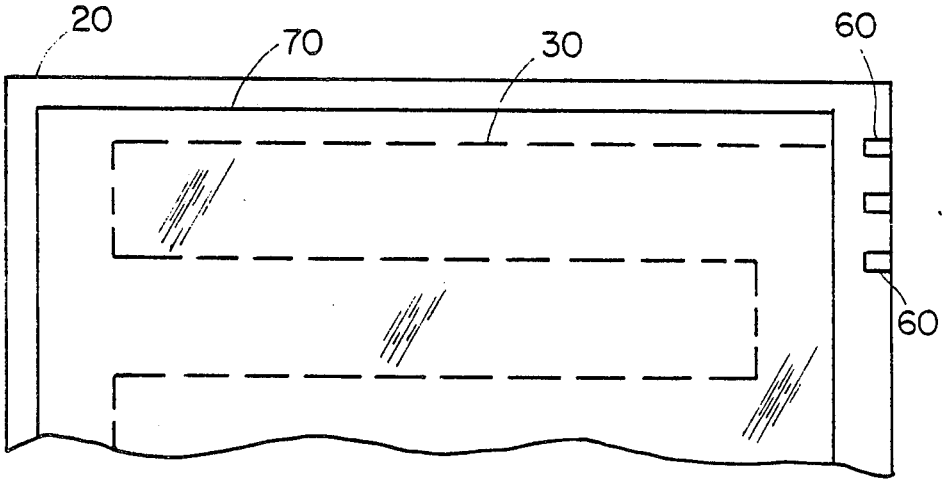
FIG. 3 is a plan view of the base plate of the panel of the invention at one stage in its preparation.
Figure 5:
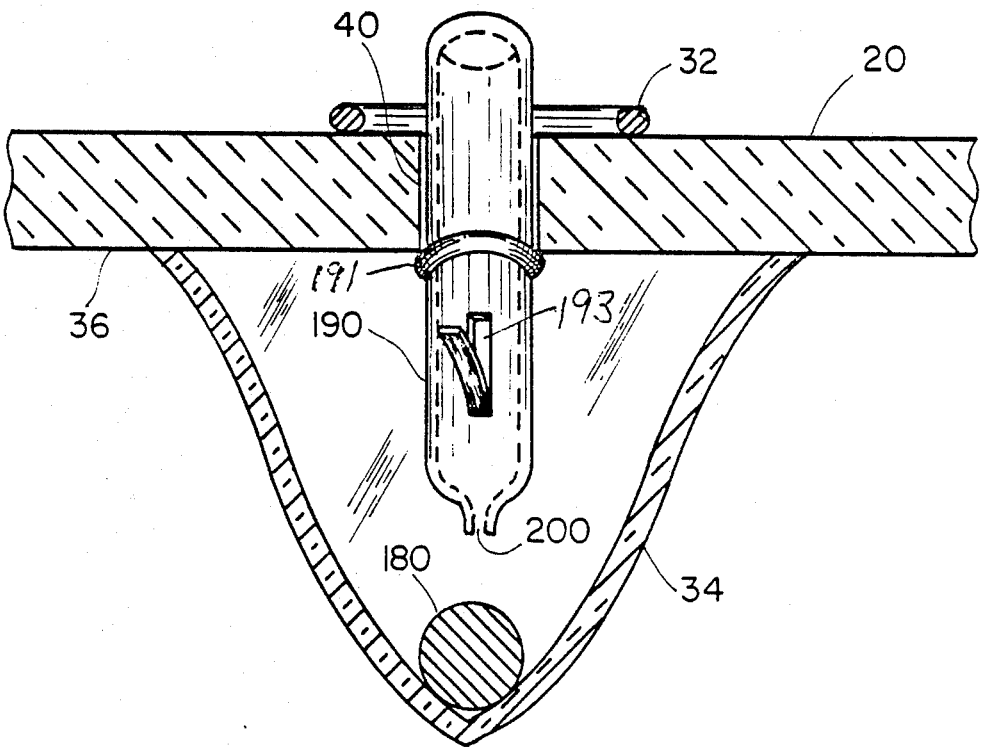
FIG. 5 is a sectional view of portion of the base plate and the tubulation carried thereby.
Figure 6:
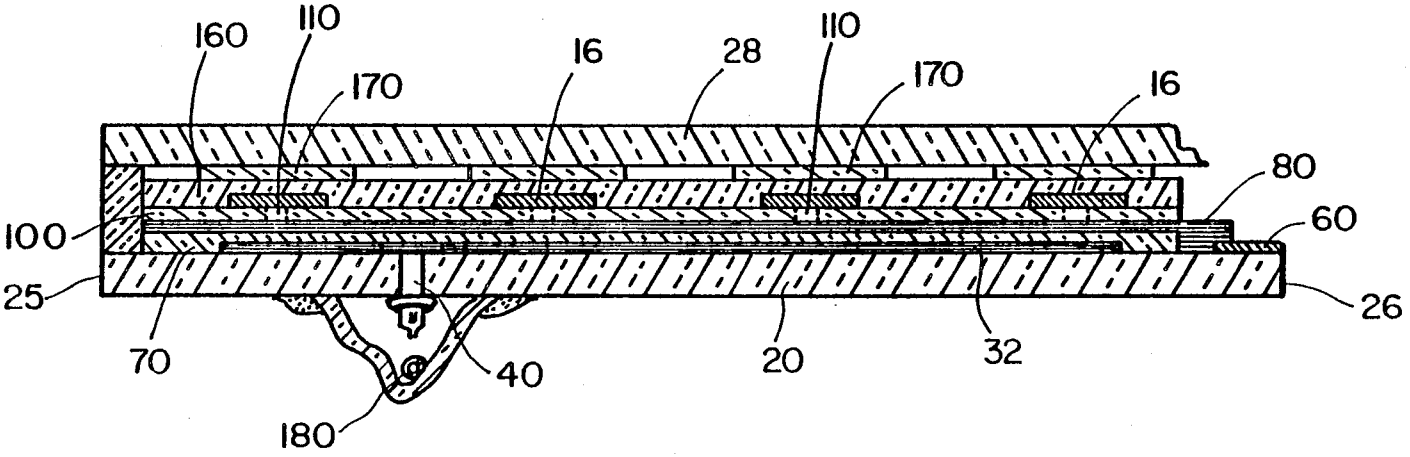
FIG. 6 is a sectional view along the long axis of the panel and through the tubulation hole in FIG. 1.

According to the invention and referring to FIG. 3, the heater 30 is in the form of a thin wire-like conductor formed on the top surface 22 of the base plate 20, for example by a screening operation using a suitable conductive material including for example nickel, silver or some other suitable metal. The heater conductor 30 covers all portions of the base plate and extends to all of the edges of the base plate so that it can provide heat to the entire area of the panel including the seal area. In addition, the heater conductor 30 includes a leg 32 which lies close to the source of mercury which is provided for the panel. The mercury source is held in a glass tubulation 34 (FIG. 5) secured to the outer or rear surface 36 of the base plate in alignment with a hole 40 in the base plate. The heater leg 32 curves about a portion of the hole 40 for optimum effect. This tubulation and mercury source are described in greater detail below.

The heater conductor 30 zig-zags across the base plate by means of a plurality of parallel, horizontal and vertical legs, beginning at the top near the upper edge 23 of the base plate and extending to near the bottom edge 24 of the base plate. Each leg also extends from near the right hand edge 26 to near the left hand edge 25 of the base plate. Adjacent parallel, horizontal legs are suitably spaced from each other for the intended purpose.

The total length of the heater conductor 30 is designed to have a desired resistance and, to modify the resistance, if necessary, a T-shaped shorting bar 50 is provided between two adjacent legs 42 and 44 of the heater conductor. This shorting bar includes a long conductor 52 between legs 42 and 44 of the heater conductor and an end bar 54 having its ends close to the adjacent ends of the two legs 42 and 44 so that the "T" can be electrically connected, as described below, to one or both of the adjacent legs. More than one shorting bar can be provided if required.

At the same time that the heater conductor is screened on the face plate, an array of contact pads 60 are formed along the right hand edge 26 of the base plate. These pads are used for making external connection to the panel electrodes, as described below.

Next, a black glass insulating layer 70 is formed over the heater conductor 30, shown in dash lines in part in FIG. 3, but not covering pads 60 or the seal area along the periphery of the base plate. In the final operating panel, this layer 70 serves as a barrier to the mercury in the panel and prevents the mercury from reaching the heater conductor if the heater conductor is made of a metal which can be adversely affected by mercury.

Next, the conductive runs 80 (FIG. 2) for interconnecting the cathodes 16 and connecting them to contact pads 60, are formed, for example by screening them on the insulating glass layer 70. These conductive runs are also formed of any suitable material, usually containing nickel as is well known in the art. The runs 80 comprise separate parallel conductors each of which is electrically connected to a pad 60 and each of which is positioned to make connection to the proper cathode as is well known in segment-type display panels. Three conductors 90, one for each cathode array 12, are also screened on for use as keep-alive cathodes as described below (FIG. 3). All connections to pads 60 are not shown since this feature is well known to those skilled in the art.

Figure 4:
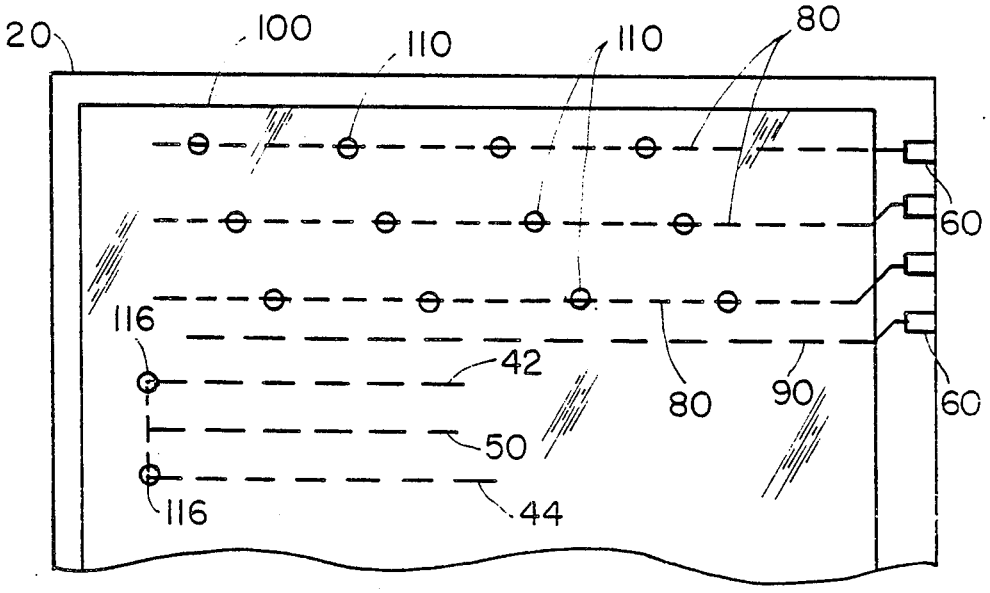
FIG. 4 is a plan view of the base plate of FIG. 3 illustrating other stages in its preparation.

Next, an insulating coating 100 is provided over the base plate (FIG. 4), except for the pads 60 and the base plate seal area along the periphery of the base plate. The coating 100 covers the cathode runs 80 and 90 but it has small openings or vias 110 at the proper locations overlying the runs so that when the cathode segments 16 are later screened on the insulating layer 100, each cathode as required makes contact through a via with its proper conductive run 80. Thus, each cathode is also connected to a contact pad 60. A typical array of vias for one group of cathodes is shown schematically in FIG. 4.

In addition, vias 116 are provided over the areas where the ends of the shorting bar 50 lie adjacent to the ends of the legs 42 and 44 of the heater conductor 30 so that adjustments in the resistance of the heater conductor can be made as described below.

Vias 120 (FIG. 4) are also provided along the lengths of the keep-alive conductors 90, one for each character position in each array of character positions.

Figure 2:
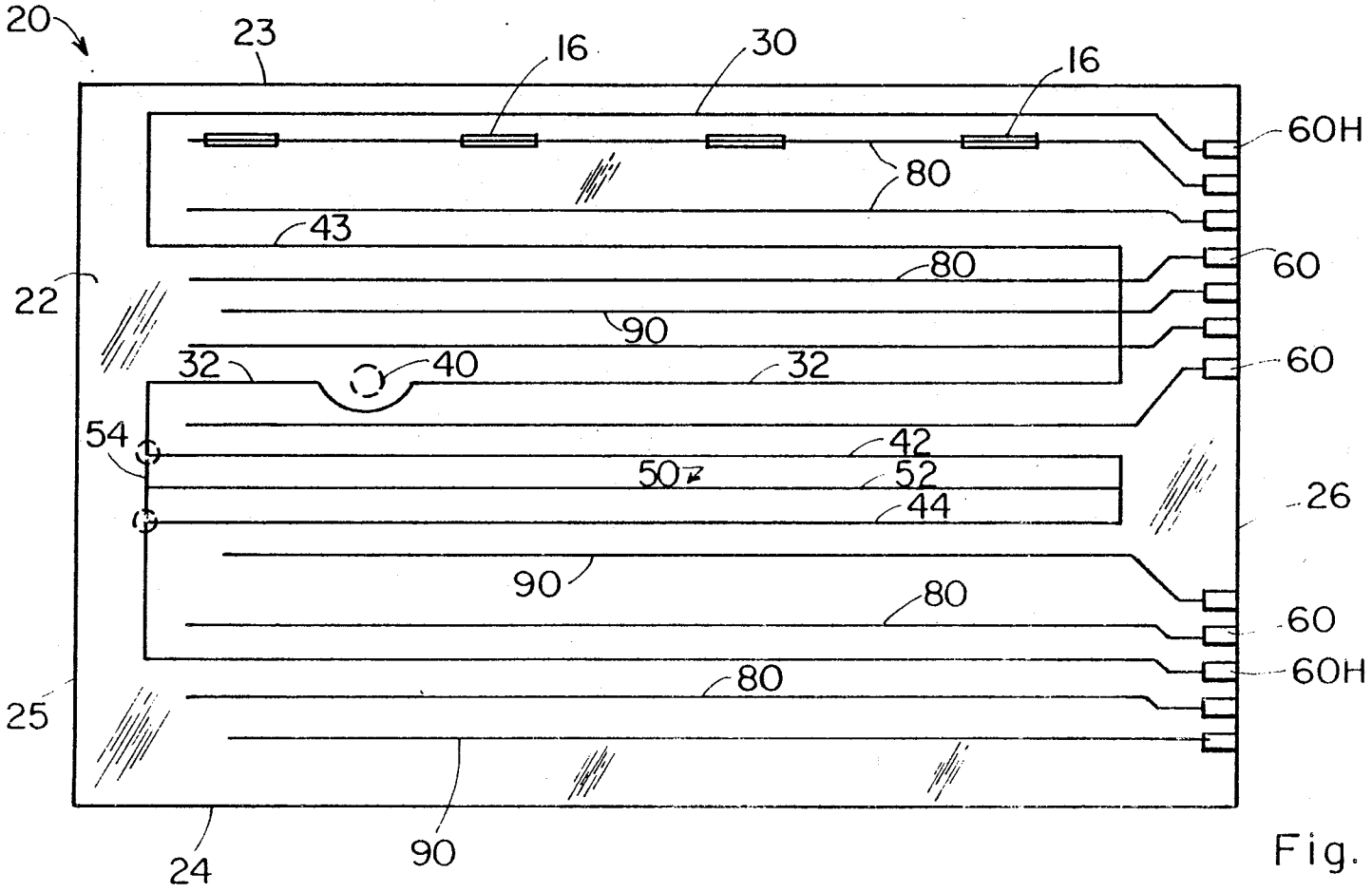
FIG. 2 is a plan view of the base plate of the panel of the invention showing various elements carried thereby.

Next, the glow cathodes 16 are screened on the insulating layer 100 with any suitable conductive material usually containing nickel. The cathodes 16 are connected to their conductive runs 80 to permit multiplexed operation of the panel as described in more detail below and as well known in the art. Thus, in each horizontal array 12 of cathode groups 14, corresponding cathode segments are connected through vias 110 to the same conductive run 80 so that all corresponding cathode segments in an array can receive energizing display signals at the same time as is well known in the art. Thus, as illustrated in FIG. 2, the topmost horizontal cathode segments are connected through vias to the uppermost horizontal conductor. The other corresponding cathode segments are similarly connected to their conductors.

At this time, the resistance of the heater conductor 30 is measured and, if necessary, the resistance is altered by connecting or shorting the T-bar 54 to the adjacent heater legs 42 and 44 by the deposition of conductive material, cathode material if desired, in one or both of the vias 160 provided for this purpose.

A black glass insulating layer 160 is then provided covering the base plate and covering everything except the seal area, the pads 60 and the cathode segments which are outlined by this insulating layer. This layer also includes vias 120 overlying and exposing the keep-alive electrodes 90, one such via being provided for each group of cathodes or character positions. This permits the keep-alive electrodes 90 to "see" the panel anodes to be described.

It is understood that, at each step in the manufacturing process, a baking operation or other operations may be employed to process the panel as is required.

The anode electrodes 170 for the panel 10 (FIG. 1) are transparent conductors formed on the inner surface of the face plate 28, each anode being columnar in shape and overlying the same corresponding character position or group of cathodes in each array of cathodes. Thus, the leftmost anode overlies the leftmost group of cathodes in each array, the next adjacent anode overlies the next adjacent group of cathodes to the right, etc. The anodes include runs which extend to the right hand edge of the face plate above the contact pads 60 so that electrical connection can be made between the anodes and contact pads. Each of the anodes has its own electrical connection and pad 60.

The panel 10 includes the glass tubulation 34 secured to the bottom or outer surface 36 of the base plate 20 and communicating with the interior of the panel and with the gas filling therein through the hole 40 in the base plate. The hole is not obstructed by any of the layers of electrodes formed on the base plate during manufacture of the panel.

In addition, since a globule 180 of mercury is present in the tubulation of the completed panel, means are provided to prevent solid mercury from entering the panel through the hole 40. One means of this type comprises a tube 190 of metal or the like (FIG. 5) inserted in the hole 40 in the base plate in a relatively tight fit aided by an annular rib which butts up against the bottom surface of the base plate. The tubular shield 190 has a constricted open lower end 200 small enough to admit only mercury vapor and near its upper end there is an opening in its wall which permits mercury vapor to enter the panel to perform the desired function of preventing cathode sputtering.

In one method of providing the mercury globule in the tubulation 34, when first secured to the base plate, the tubulation is relatively long and carries a black glass capsule containing a quantity of mercury, the capsule being held in place by a constriction in the tubing at a suitable distance from the base plate. The glass capsule is shattered by infrared radiation to release the mercury into the tubing from which it enters the tubulation near the base plate where it remains. After the mercury has been seated in the tubulation near the base plate, the excess length of tubulation is removed and the remaining short tubulation 34 is hermetically sealed off, at a suitable time in the processing of the panel. As noted, various processing steps such as bake-out, etc. would be employed but they need not be described.

It is noted, however, that sometime during the process the desired ionizable gass filling of argon, neon, xenon or the like, simply or in continuation is introduced into the panel envelope at the desired pressure.

The panel face plate 28 and base plate 20, carrying their respective electrodes, are hermetically sealed together in any suitable manner and using any suitable cement which is placed around the peripheries of the two places where they are to be sealed together, and the panel is processed to completion by fusing the sealing cements and then processing the panel with bake-out, filling with gas, sealing off the tubulation, and releasing the mercury into the panel. All of the manufacturing steps would be well known to those skilled in the art.

To make electrical contact to the panel, elongated contact pins 210 are secured to the pads 60 with a suitable cement. If desired, the inner ends of the elongated pins may be inserted into a space between the face plate and base plate in contact with the pads. This is not shown.

In operation of the panel 10, a source of alternating current is connected to the ends of the heater conductor 30 at their pads 60H and the resultant current flow generates heat sufficient to keep the mercury vaporized in the panel at temperatures at which mercury would normally condense. Since the heater 30 lies close to and partly encircles the tubulation hole 40 where the globule of mercury is near, the heat can keep vaporized mercury in the panel. In addition, since the heater extends close to the entire panel seal area, mercury cannot condense here and become unavailable to the cathodes.

To display characters in a multiplex mode of operation, in each array of cathode groups, the anode receives positive potential and negative display signals are simultaneously applied to the conductor runs through their pads which are connected to cathodes which are to be caused to glow. Each anode is energized in turn along with the desired associated cathodes and the panel is cycled in this way continuously to provide apparently stationary but changeable visible characters at each character position.

What is claimed is:

1. A display panel comprising an envelope made up of a base plate and a glass face plate heremetically sealed together and filled with an ionizable gas of the type which can support cathode glow, an array of cathode electrodes adjacent to said base plate and anode means adjacent to said face plate, a source of mercury adjacent to said base plate, and heater means provided in said envelope in operative relations with substantially the entire area of said base plate and the seal between said base plate and said face plate and said source of mercury, said heater means including a portion which encircles a portion of the area of said base plate which said source of mercury is adjacent to, so that no gobules of mercury appear in said panel which might cause electrical shorts.

2. The panel defined in claim 1 wherein said heater means comprises conductive runs on said base plate.

3. The panel defined in claim 1 wherein said heater means comprises an array of conductor runs extending over said base plate so that heat generated thereby is felt in all portions of said panel.

4. The panel defined in claim 1 wherein said heater means is positioned to generate heat in the vicinity of said source of mercury.

5. The panel defined in claim 1 wherein a hole is provided in said base plate in alignment with said source of mercury which is in a tubulation secured to the outer surface of said base plate, and said heater means includes portion which extends between two edges of said base plate and includes a portion which is disposed close to and curves around said hole.

6. The panel defined in claim 3 and including a T-shaped shorting bar disposed between two of said conductor runs and positioned to be electrically connected to said two conductor runs to modify the resistance of said heater means.

7. The panel defined in claim 1 and including a hole in said base plate in communication with said source of mercury and said portion of said heater means encircles a portion of said hole inside said panel and applies heat thereto in operation.

* * * * *